US009539716B2

(12) United States Patent
Leupert et al.

(10) Patent No.: US 9,539,716 B2
(45) Date of Patent: Jan. 10, 2017

(54) HAND-HELD POWER TOOL WITH AN ERGONOMIC HANDLE

(71) Applicant: Robert Bosch GmbH, Stuttgart (DE)

(72) Inventors: Markus Leupert, Murrhardt (DE); Hans Bargen, Korntal-Münchingen (DE)

(73) Assignee: Robert Bosch GmbH, Stuttgart (DE)

( * ) Notice: Subject to any disclaimer, the term of this patent is extended or adjusted under 35 U.S.C. 154(b) by 458 days.

(21) Appl. No.: 14/154,249

(22) Filed: Jan. 14, 2014

(65) Prior Publication Data

US 2014/0196923 A1 Jul. 17, 2014

(30) Foreign Application Priority Data

Jan. 16, 2013 (DE) ..... 10 2013 200 576

(51) Int. Cl.
*B25F 5/02* (2006.01)

(52) U.S. Cl.
CPC ..... *B25F 5/02* (2013.01); *Y10T 16/476* (2015.01)

(58) Field of Classification Search
CPC ..... B25F 5/00; B25F 5/02
USPC ..... 173/170, 168, 217, 171; D8/68, 61, 62, D8/65; 16/430, 431, 422
See application file for complete search history.

(56) References Cited

U.S. PATENT DOCUMENTS

D335,073 S * 4/1993 Anthony ..... D8/61
D380,658 S * 7/1997 Bruno ..... D24/146
6,102,134 A * 8/2000 Alsruhe ..... B25F 5/02 173/170
6,364,033 B1 * 4/2002 Hung ..... B25F 5/021 173/170
D499,945 S * 12/2004 Sugawara ..... D8/68
D512,891 S * 12/2005 Aglassinger ..... D8/68
D526,176 S * 8/2006 Lopano ..... D8/61
D536,944 S * 2/2007 Tsai ..... D8/68
D551,047 S * 9/2007 Lopano ..... D8/68
7,481,135 B2 * 1/2009 Schoenbeck ..... B25G 1/066 16/110.1
D601,873 S * 10/2009 Lau ..... D8/62
D646,947 S * 10/2011 Lopano ..... D8/68
8,113,297 B2 * 2/2012 Sakakibara ..... B25F 5/02 173/162.1
8,267,192 B2 * 9/2012 Lopano ..... B25F 5/02 173/168

(Continued)

FOREIGN PATENT DOCUMENTS

EP 2 221 150 A1 8/2010

*Primary Examiner* — Scott A. Smith
(74) *Attorney, Agent, or Firm* — Maginot, Moore & Beck LLP

(57) ABSTRACT

A hand-held power tool includes a tool housing on which an ergonomic handle is formed for a user's hand, including the user's thumb, index finger, middle finger, ring finger, and small finger. The handle includes a first region for the index finger and the thumb, a second region for the middle finger, a third region for the ring finger, and a fourth region for the small finger. The second region has an approximately oval cross section with a first main axis and a first secondary axis. The third region has an approximately oval cross section with a second main axis and a second secondary axis. The fourth region has an approximately oval cross section with a third main axis and a third secondary axis. The first main axis is longer than the second main axis, and the first secondary axis is shorter than the second and third secondary axes.

16 Claims, 3 Drawing Sheets

(56) References Cited

U.S. PATENT DOCUMENTS

| | | | | |
|---|---|---|---|---|
| 2003/0200841 | A1* | 10/2003 | Novotny | B25F 5/02<br>81/177.8 |
| 2010/0163265 | A1* | 7/2010 | Hozumi | B25F 5/02<br>173/217 |
| 2010/0252293 | A1* | 10/2010 | Lopano | B25F 5/02<br>173/170 |
| 2011/0079409 | A1* | 4/2011 | Sakakibara | B25F 5/02<br>173/170 |

* cited by examiner

HAND-HELD POWER TOOL WITH AN ERGONOMIC HANDLE

This application claims priority under 35 U.S.C. §119 to patent application no. DE 10 2013 200 576.8 filed on Jan. 16, 2013 in Germany, the disclosure of which is incorporated herein by reference in its entirety.

BACKGROUND

The present disclosure relates to a hand-held power tool with a tool housing on which an ergonomic handle for a user's hand provided with a thumb, an index finger, a middle finger, a ring finger and a small finger is formed, wherein a first region for the index finger and the thumb, a second region for the middle finger, a third region for the ring finger and a fourth region for the small finger are provided on the handle, and wherein the second region has an at least approximately oval cross section with a first main axis and a first secondary axis, the third region has an at least approximately oval cross section with a second main axis and a second secondary axis and the fourth region has an at least approximately oval cross section with a third main axis and a third secondary axis.

EP 2 221 150 A1 discloses a hand-held power tool of this type, the tool housing of which is provided with an ergonomic handle on which a first region for an index finger and thumb, a second region for a middle finger, a third region for a ring finger and a fourth region for a small finger of a user's hand are provided. The first, second, third and fourth region each have an oval cross section with assigned main and secondary axes, wherein the third region has the longest main axis and the fourth region has the longest secondary axis.

A disadvantage with the prior art is that the user's hand may become fatigued despite the ergonomic handle in the event of prolonged, in particular uninterrupted, operation of a hand-held power tool of this type, and therefore the handling of the hand-held power tool is perceived to be uncomfortable in each case after a corresponding time period. Furthermore, fatigue of this type may result in a reduction in a desired working precision.

It is therefore an object of the disclosure to provide a novel hand-held power tool with an ergonomic handle, in which, even in the event of prolonged, in particular uninterrupted, operation, fatigue which occurs of a user's hand can be at least reduced.

SUMMARY

This problem is solved by a hand-held power tool with a tool housing on which an ergonomic handle for a user's hand provided with a thumb, an index finger, a middle finger, a ring finger and a small finger is formed. A first region for the index finger and the thumb, a second region for the middle finger, a third region for the ring finger and a fourth region for the small finger are provided on the handle. The second region has an at least approximately oval cross section with a first main axis and a first secondary axis, the third region has an at least approximately oval cross section with a second main axis and a second secondary axis and the fourth region has an at least approximately oval cross section with a third main axis and a third secondary axis. The first main axis or the third main axis is longer than the second main axis, and the first secondary axis is shorter than the second and third secondary axes.

The disclosure therefore permits the provision of a hand-held power tool with an ergonomic handle, in which a substantially fatigue-free and comfortable operation of the hand-held power tool is made possible by improved adaptation of the handle to the anatomy of a user's hand.

The third main axis and the third secondary axis are preferably at least approximately identical in length.

An at least approximately circular cross section can therefore be provided on the ergonomic handle for the small finger of the user's hand, said cross section permitting improved gripping of the handle with the small finger.

According to one embodiment, the tool housing has a housing longitudinal axis which is arranged at a predetermined angle transversely with respect to a handle longitudinal axis assigned to the handle, wherein the first main axis is longer than the second and third main axes.

The disclosure therefore permits the provision of a hand-held power tool with what is referred to as a "central handle" which is designed in the manner of an ergonomic handle and has improved adaptation to the anatomy of a user's hand in order to permit a substantially fatigue-free and comfortable operation of the hand-held power tool.

The first main axis is preferably at least 48 mm in length and the second main axis is at least 46 mm in length.

A secure and comfortable gripping of those regions on the central handle that are assigned to the middle and ring fingers of a user's hand can therefore be made possible at least for a user having middle and ring fingers of average length.

The second main axis is preferably longer than the third main axis.

The region assigned to the ring finger of the user's hand can therefore be designed in a simple manner to be longer than the region assigned to the small finger.

The third main axis is preferably at least 43 mm in length.

A reliable and comfortable gripping of that region on the central handle which is assigned to the small finger of a user's hand can therefore be made possible at least for a user with a small finger of average length.

The second secondary axis is preferably shorter than the third secondary axis.

An at least approximately identical angular region of those regions of the ergonomic central handle which are assigned to the ring finger and small finger can therefore be grasped in a simple manner by said two fingers.

Preferably, the first secondary axis is at maximum 38 mm in length, the second secondary axis is at maximum 40 mm in length and the third secondary axis is at least 43 mm in length.

A comfortable, secure and reliable gripping of the ergonomic central handle of the hand-held power tool can therefore be made possible.

According to one embodiment, the tool housing and the handle have a common longitudinal axis, wherein the third main axis is longer than the first and second main axes.

The disclosure therefore permits the provision of a hand-held power tool with what is referred to as a "longitudinal handle" which is designed in the manner of an ergonomic handle and has better adaptation to the anatomy of a user's hand in order to permit a substantially fatigue-free and comfortable operation of the hand-held power tool.

The third main axis is preferably at least 40.6 mm in length and the second main axis is at least 40.4 mm in length.

A construction of the ergonomic longitudinal handle that is more slender than the central handle can therefore be made possible in a simple manner, in order to permit the provision of an overall more slender hand-held power tool which is thus suitable for use in working regions in which a hand-held power tool designed with a central handle is usable only with difficulty, if at all.

The second main axis is preferably longer than the first main axis.

Secure gripping of the ergonomic longitudinal handle, in particular by middle and ring fingers, can therefore be made possible, as a result of which improved guidance of the hand-held power tool during the operation thereof can be achieved.

The first main axis is preferably at maximum 40.3 mm in length.

A reliable and comfortable gripping of that region on the longitudinal handle which is assigned to the middle finger of a user's hand can therefore be made possible, at least for a user with a middle finger of average length.

The second secondary axis is preferably shorter than the third secondary axis.

A larger angular region of that region of the ergonomic longitudinal handle which is assigned to the ring finger can therefore be grasped in a simple manner with said ring finger than with the small finger.

The first secondary axis is at maximum 37 mm in length, the second secondary axis is at maximum 39 mm in length and the third secondary axis is at least 40 mm in length.

A comfortable, secure and reliable gripping of the ergonomic longitudinal handle of the hand-held power tool can therefore be made possible.

The problem mentioned at the beginning is also solved by a tool housing for a hand-held power tool, on which an ergonomic handle for a user's hand provided with a thumb, an index finger, a middle finger, a ring finger and a small finger is formed, wherein a first region for the index finger and the thumb, a second region for the middle finger, a third region for the ring finger and a fourth region for the small finger are provided on the handle. The second region has an at least approximately oval cross section with a first main axis and a first secondary axis, the third region has an at least approximately oval cross section with a second main axis and a second secondary axis and the fourth region has an at least approximately oval cross section with a third main axis and a third secondary axis. The first main axis or the third main axis is longer than the second main axis, and the first secondary axis is shorter than the second and third secondary axes.

Furthermore, the problem mentioned at the beginning is also solved by an ergonomic handle for a user's hand provided with a thumb, an index finger, a middle finger, a ring finger and a small finger, wherein a first region is provided for the index finger and the thumb, a second region is provided for the middle finger, a third region is provided for the ring finger and a fourth region is provided for the small finger. The second region has an at least approximately oval cross section with a first main axis and a first secondary axis, the third region has an at least approximately oval cross section with a second main axis and a second secondary axis and the fourth region has an at least approximately oval cross section with a third main axis and a third secondary axis. The first main axis or the third main axis is longer than the second main axis, and the first secondary axis is shorter than the second and third secondary axes.

BRIEF DESCRIPTION OF THE DRAWINGS

The disclosure is explained in more detail in the description below with reference to exemplary embodiments which are illustrated in the drawings, in which.

DETAILED DESCRIPTION

Figure 1:
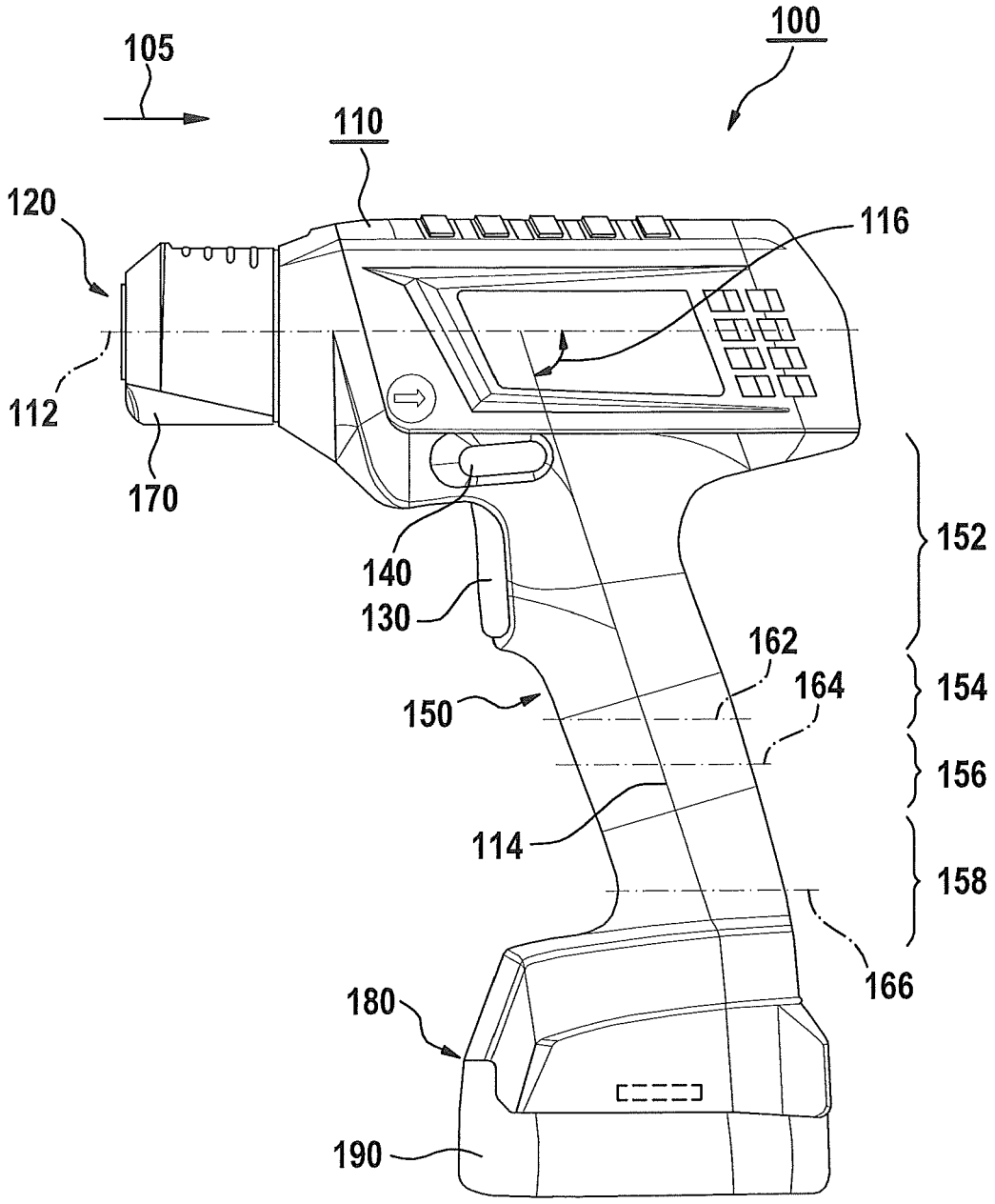
FIG. 1 shows a schematic view of a hand-held power tool with a tool housing according to a first embodiment.

FIG. 1 shows a hand-held power tool 100 which is provided with a tool-holding fixture 120 and optional working area illumination 170 and which has a tool housing 110 with a handle 150. The hand-held power tool 100 is actuable, i.e. is switchable on and off, for example, via a manual switch 130 and has an optional direction of rotation switch 140 via which a respective direction of rotation of the hand-held power tool 100 can preferably be set.

The tool-holding fixture 120 is preferably designed in the manner of a bit holder, i.e. for receiving an insert tool which is designed in the manner of a screwdriver bit and is pushed in the direction of the hand-held power tool 100 into the tool-holding fixture 120, as indicated with an arrow 105. A screwdriver bit of this type, which is, for example, of the "HEX type", is well known from the prior art, and therefore, for the purpose of keeping the description concise, a detailed description is omitted here. However, it is emphasized that the present disclosure is not restricted to use of HEX screwdriver bits, but rather other insert tools can also be used depending on a respectively selected configuration of the tool-holding fixture 120, for example HEX drill or "SDS-Quick" insert tools. Furthermore, it is emphasized that the construction and the functioning of a suitable tool-holding fixture are also well known to a person skilled in the art, and therefore, for the purpose of keeping the description concise, a detailed description of the tool-holding fixture 120 is omitted here.

By way of illustration, the hand-held power tool 100 is mechanically and electrically connected to a battery pack 190 for power supply independently of the mains. In this connection, the battery pack 190 can be designed in the manner of an alternating battery and, at an assigned intersection 180 of the hand-held power tool 100, can be mechanically and electrically connected thereto, or, as an alternative thereto, can be installed, for example, as an integral component of the hand-held power tool 100, for example in the handle 150 thereof.

By way of example, the hand-held power tool 100 is designed as a battery-operated rotary percussion screwdriver. However, it is emphasized that the present disclosure is not restricted to battery-operated rotary percussion screwdrivers, but rather can be used in different hand-held power tools which have a handle corresponding to the handle 150, irrespective of whether the hand-held power tool is operable electrically, i.e. by the battery pack 190 independently of the mains or depending on the mains, and/or non-electrically.

It is emphasized that a suitable construction of the hand-held power tool 100 as such is well known to a person skilled in the art from the prior art and is not the subject matter of the provisional disclosure. A detailed description of this construction, which comprises, for example, an electric driving motor arranged in the tool housing 110, a gearing and an optional percussion mechanism, wherein the driving motor can be an electronically commutated driving motor or a commutator motor fitted with brushes, is therefore omitted for the purpose of keeping the description concise.

According to a first embodiment, the tool housing 110 has a housing longitudinal axis 112 which is arranged at a predetermined angle 116 transversely with respect to a handle longitudinal axis 114 assigned to the handle 150. The predetermined angle 116 is preferably selected to be greater than 30°, particularly preferably at least from a range of 45° to 90°, and is, by way of example, approximately 72.5°. This is the case, for example, with a battery-operated screwdriver.

Furthermore, the tool housing 110 is, by way of example, of approximately T-shaped design, wherein the handle 150 is arranged approximately centrally on that section of the tool housing 110 which has the housing longitudinal axis 112. The handle 150 is therefore also referred to below as a "central handle". However, it is emphasized that said approximately central arrangement of the handle 150 merely has an exemplary character and should not be understood as a limitation of the disclosure. On the contrary, the handle 150 can also be arranged further to the left or right—in FIG. 1—on that section of the tool housing 110 which has the housing longitudinal axis 112.

The central handle 150 is designed in the manner of an ergonomic handle for a user's hand provided with a thumb, an index finger, a middle finger, a ring finger and a small finger. For this purpose, the central handle 150 is divided into four regions: a first region 152 for the index finger and the thumb, a second region 154 for the middle finger, a third region 156 for the ring finger and a fourth region 158 for the small finger. At least the second, third and fourth regions 154, 156 and 158, respectively, have an at least approximately oval cross section. By way of illustration, the second region 154 has an at least approximately oval cross section 162, the third region 156 has an at least approximately oval cross section 164 and the fourth region 158 has an at least approximately oval cross section 166. Said oval cross sections 162, 164, 166 are arranged parallel to one another and to the housing longitudinal axis 112.

Figure 2:
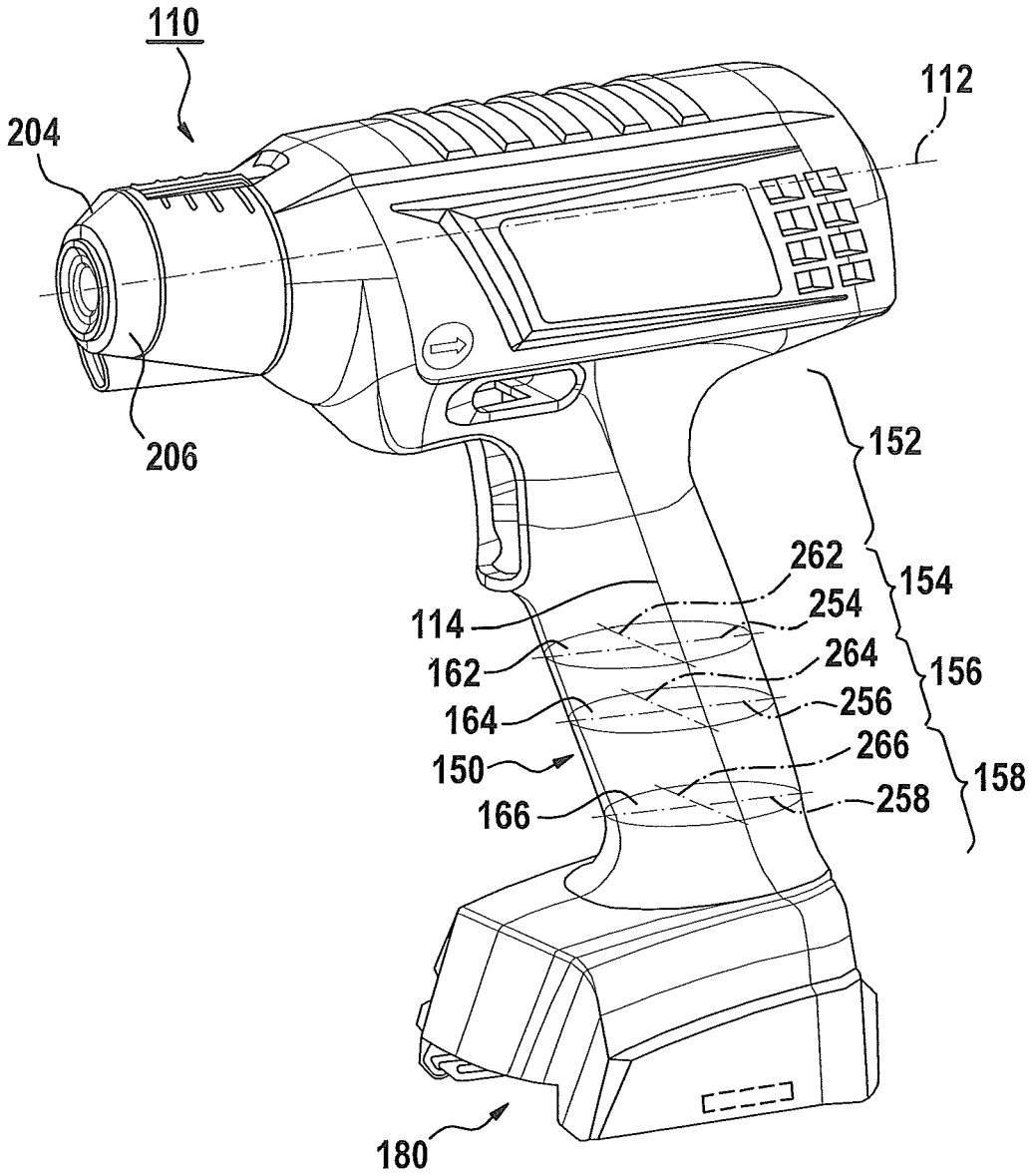
FIG. 2 shows a perspective, partially transparent view of the tool housing of FIG. 1.

FIG. 2 shows the tool housing 110 of the hand-held power tool 100 from FIG. 1, said tool housing having the housing longitudinal axis 112 and the intersection 180. The tool housing 110 has, by way of example, a first and a second housing shell 204, 206. When the hand-held power tool 100 from FIG. 1 is fully assembled, said first and second housing shells 204, 206 can be fastened to each other in any suitable manner, for example by means of latching, screwing, welding and/or adhesive bonding.

As described for FIG. 1, the tool housing 110, according to a first embodiment, is provided with the ergonomic central handle 150 which has a handle longitudinal axis 114 and the first, second, third and fourth regions 152, 154, 156 and 158. By way of illustration, the second region 154 with the at least approximately oval cross section 162 has a first main axis 254 and a first secondary axis 262. The third region 156 with the at least approximately oval cross section 164 has, by way of illustration, a second main axis 256 and a second secondary axis 264. By way of illustration, the fourth region 158 with the at least approximately oval cross section 166 has a third main axis 258 and a third secondary axis 266.

According to the first embodiment, the first main axis 254 is at least longer than the second main axis 256 and is particularly preferably longer than the second and third main axes 256 and 258, respectively. Furthermore, the second main axis 256 is preferably longer than the third main axis 258. By way of example, the first main axis 254 is at least 48 mm in length and the second main axis 256 is at least 46 mm in length. The third main axis 258 is preferably at least 43 mm in length.

The first secondary axis 262 is shorter than the second and third secondary axes 264 and 268, respectively. Furthermore, the second secondary axis 264 is preferably shorter than the third secondary axis 266 which, for its part, is preferably at least approximately the same length as the third main axis 258. By way of example, the first secondary axis 262 is at maximum 38 mm in length, the second secondary axis 264 is at maximum 40 mm in length and the third secondary axis 266 is at least 43 mm in length.

Figure 3:
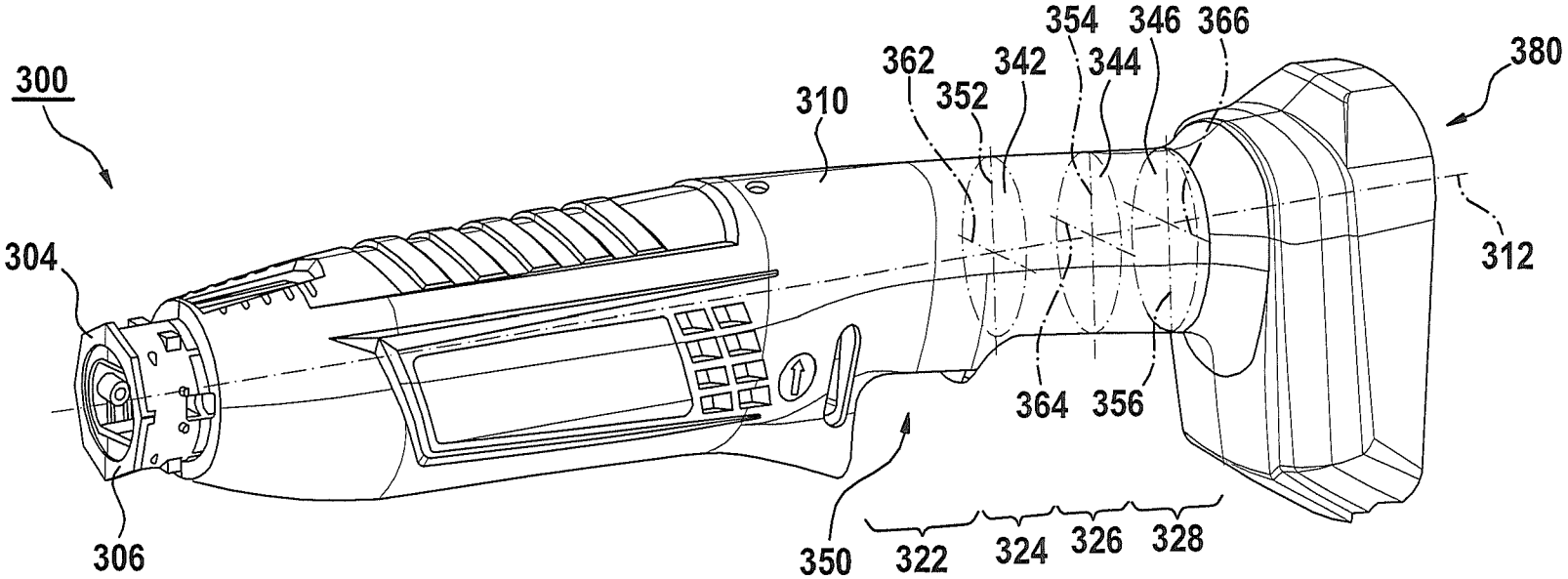
FIG. 3 shows a perspective, partially transparent view of a tool housing according to a second embodiment.

FIG. 3 shows a hand-held power tool 300 with a tool housing 310 on which a handle 350 according to a second embodiment is formed. To simplify the drawing and the description, only the tool housing 310 of the hand-held power tool 300 is shown, since the basic construction of the hand-held power tool 300 like the construction of the hand-held power tool 100 from FIG. 1 is well known to a person skilled in the art and is not the subject matter of the present disclosure.

The tool housing 310 has, by way of example, a first and a second housing shell 304, 306. When the hand-held power tool 300 is fully assembled, said housing shells 304, 306 can be fastened to each other in any suitable manner, for example by means of latching, screwing, welding and/or adhesive bonding. Furthermore, the tool housing 310 is provided, by way of example, with an intersection 180 at which a battery pack, for example the battery pack 190 from FIG. 1, can be mechanically connected to the tool housing 310.

In contrast to the tool housing 110 and the central handle 150 from FIGS. 1 and 2, the tool housing 310 and the handle 350 according to the second embodiment have a common longitudinal axis 312. This is the case, for example, in hand-held power tools having what is referred to as an angular constructional form, for example in the case of an angle screwdriver. The handle 350 is therefore also referred to below as a "longitudinal handle". However, it is emphasized that the description of a common longitudinal axis merely has an exemplary character and should not be understood as a limitation of the disclosure. On the contrary, in the case of the tool housing 310, parallel longitudinal axes or longitudinal axes angled by up to 30° can also be used.

The longitudinal handle 350 is designed in the manner of an ergonomic handle for a user's hand provided with a thumb, an index finger, a middle finger, a ring finger and a small finger. For this purpose, the longitudinal handle 350 is divided into four regions: a first region 322 for the index finger and the thumb, a second region 324 for the middle finger, a third region 326 for the ring finger and a fourth region 328 for the small finger. At least the second, third and fourth regions 324, 326 and 328, respectively, have an at least approximately oval cross section. By way of illustration, the second region 324 has an at least approximately oval cross section 342 with a first main axis 352 and a first secondary axis 362, the third region 326 has an at least approximately oval cross section 344 with a second main axis 354 and a second secondary axis 364, and the fourth region 328 has an at least approximately oval cross section 346 with a third main axis 356 and a third secondary axis 366.

According to the second embodiment, the third main axis 356 is at least longer than the second main axis 354 and is preferably longer than the first and second main axes 352, 354. Furthermore, the second main axis 354 is preferably longer than the first main axis 352. By way of example, the third main axis 356 is at least 40.6 mm in length and the second main axis 354 is at least 40.4 mm in length. The first main axis 352 is preferably at maximum 40.3 mm in length.

The first secondary axis 362 is preferably shorter than the second and third secondary axes 364 and 366, respectively.

Furthermore, the second secondary axis 364 is preferably shorter than the third secondary axis 366. By way of example, the first secondary axis 362 is at maximum 37 mm in length, the second secondary axis 364 is at maximum 39 mm in length and the third secondary axis 366 is at least 40 mm in length.

It is also emphasized that variations of the described embodiments are possible within the scope of the present disclosure. For example, the central handle 150 of the tool housing 110 from FIGS. 1 and 2 can be designed according to the specifications of the longitudinal handle 350, or the longitudinal handle 350 can be designed according to the specifications of the central handle 150 of the tool housing 110 from FIGS. 1 and 2.

What is claimed is:

1. A hand-held power tool, comprising:

a tool housing; and an ergonomic handle formed on the tool housing and configured for a user's hand with a thumb, an index finger, a middle finger, a ring finger, and a small finger, the ergonomic handle having a first region configured for the index finger and the thumb, a second region configured for the middle finger, a third region configured for the ring finger, and a fourth region configured for the small finger, wherein the second region has an at least approximately oval cross section with a first maximum diameter and a first minimum diameter, the third region has an at least approximately oval cross section with a second maximum diameter and a second minimum diameter, and the fourth region has an at least approximately oval cross section with a third maximum diameter and a third minimum diameter, wherein the first maximum diameter or the third maximum diameter is longer than the second maximum diameter, and wherein the first minimum diameter is shorter than the second and third minimum diameters.

2. The hand-held power tool according to claim 1, wherein the third maximum diameter and the third minimum diameter are at least approximately identical in length.

3. The hand-held power tool according to claim 1, wherein the handle has a handle longitudinal axis, and the tool housing has a housing longitudinal axis arranged at a predetermined angle transversely with respect to the handle longitudinal axis, and wherein the first maximum diameter is longer than the second and third maximum diameters.

4. The hand-held power tool according to claim 3, wherein the first maximum diameter is at least 48 mm in length and the second maximum diameter is at least 46 mm in length.

5. The hand-held power tool according to claim 3, wherein the second maximum diameter is longer than the third maximum diameter.

6. The hand-held power tool according to claim 3, wherein the third maximum diameter is at least 43 mm in length.

7. The hand-held power tool according to claim 3, wherein the second minimum diameter is shorter than the third minimum diameter.

8. The hand-held power tool according to claim 3, wherein the first minimum diameter is at maximum 38 mm in length, the second minimum diameter is at maximum 40 mm in length, and the third minimum diameter is at least 43 mm in length.

9. The hand-held power tool according to claim 1, wherein the tool housing and the handle have a common longitudinal axis, and wherein the third maximum diameter is longer than the first and second maximum diameters.

10. The hand-held power tool according to claim 9, wherein the third maximum diameter is at least 40.6 mm in length and the second maximum diameter is at least 40.4 mm in length.

11. The hand-held power tool according to claim 9, wherein the second maximum diameter is longer than the first maximum diameter.

12. The hand-held power tool according to claim 9, wherein the first maximum diameter is at maximum 40.3 mm in length.

13. The hand-held power tool according to claim 9, wherein the second minimum diameter is shorter than the third secondary axis.

14. The hand-held power tool according to claim 9, wherein the first minimum diameter is at maximum 37 mm in length, the second minimum diameter is at maximum 39 mm in length, and the third minimum diameter is at least 40 mm in length.

15. A tool housing for a hand-held power tool, comprising:

an ergonomic handle formed on the tool housing and configured for a user's hand with a thumb, an index finger, a middle finger, a ring finger, and a small finger, the ergonomic handling having a first region configured for the index finger and the thumb, a second region configured for the middle finger, a third region configured for the ring finger, and a fourth region configured for the small finger, wherein the second region has an at least approximately oval cross section with a first maximum diameter and a first minimum diameter, the third region has an at least approximately oval cross section with a second maximum diameter and a second minimum diameter, and the fourth region has an at least approximately oval cross section with a third maximum diameter and a third minimum diameter, wherein the first maximum diameter or the third maximum diameter is longer than the second maximum diameter, and wherein the first minimum diameter is shorter than the second and third minimum diameters.

16. An ergonomic handle for a user's hand with a thumb, an index finger, a middle finger, a ring finger, and a small finger, comprising:

a first region configured for the index finger and the thumb;

a second region configured for the middle finger;

a third region configured for the ring finger; and a fourth region configured for the small finger, wherein the second region has an at least approximately oval cross section with a first maximum diameter and a first minimum diameter, the third region has an at least approximately oval cross section with a second maximum diameter and a second minimum diameter, and the fourth region has an at least approximately oval cross section with a third maximum diameter and a third minimum diameter, wherein the first maximum diameter or the third maximum diameter is longer than the second maximum diameter, and wherein the first minimum diameter is shorter than the second and third minimum diameters.

* * * * *